US005571025A

United States Patent [19]

Arai et al.

[11] Patent Number: 5,571,025

[45] Date of Patent: Nov. 5, 1996

[54] CIRCUIT BOARD ELECTRICAL CONNECTOR

[75] Inventors: Tatsuya Arai; Yutaka Ichimura, both of Tokyo, Japan

[73] Assignee: Hirose Electric Co., Ltd., Tokyo, Japan

[21] Appl. No.: 355,169

[22] Filed: Dec. 8, 1994

[30] Foreign Application Priority Data

Dec. 16, 1993 [JP] Japan ..... 5-72338 U

[51] Int. Cl.[6] ..... H01R 13/62

[52] U.S. Cl. ..... 439/160; 439/377

[58] Field of Search ..... 439/377, 152.160, 439/377, 152–160

[56] References Cited

U.S. PATENT DOCUMENTS

| | | | |
|---|---|---|---|
| 4,241,966 | 12/1980 | Gomez | 439/157 |
| 4,521,063 | 6/1985 | Milc | 439/157 |
| 4,898,540 | 2/1990 | Saito | 439/153 |
| 4,990,097 | 2/1991 | Billman et al. | 439/160 |
| 5,006,951 | 4/1991 | Albert et al. | 439/157 |
| 5,070,529 | 12/1991 | Beaufort et al. | 439/74 |
| 5,074,800 | 12/1991 | Sasao et al. | 439/157 |
| 5,108,298 | 4/1992 | Simmel | 439/157 |
| 5,389,000 | 2/1995 | DiViesti et al. | 439/157 |
| 5,429,523 | 7/1995 | Tondreault | 439/157 |

*Primary Examiner*—P. Austin Bradley
*Assistant Examiner*—Jill DeMello
*Attorney, Agent, or Firm*—Kanesaka & Takeuchi

[57] ABSTRACT

A circuit board electrical connector includes a housing (10); a plurality of contact elements (25) arranged in the housing; a receiving recess (23) provided in the housing for receiving a circuit board (1) such that contact pads (2) of the circuit board are brought into contact with the contact elements; an ejector (40) provided on the housing for ejecting the circuit board so as to release the contact between the circuit board and the contact elements; a slide portion (41) provided on the ejector and having an action face (49) at a lower end thereof; a finger portion (42) provided on the ejector and having a bearing face (46) for abutting action face to receive a pushing force from the slide portion for rotation to lift the circuit board; and fulcrum means (26) provided in the housing for support the finger portion between bearing face and a front end for rotation.

7 Claims, 10 Drawing Sheets

CIRCUIT BOARD ELECTRICAL CONNECTOR

BACKGROUND OF THE INVENTION

1. Field of the Invention

The present invention relates to electrical connectors for connecting circuit boards.

2. Description of the Related Art

In order to pull out a circuit board, most electrical connectors of this type are provided with an ejector so as to release the connection with contact elements without excessive forces. The known ejectors include those of the lever type and the lift type.

An electrical connector of the lever type is disclosed in U.S. Pat. No. 4,898,540, for example. As shown in FIG. 14, this electrical connector is provided with an lever-type ejector 53 on an side of a housing 50 for turning movement about a pin 52. The housing 50 is provided with a receiving recess 51 for receiving a circuit board 60 such that the connection pads 61 are brought into contact with contact elements which are arranged in the receiving recess 51. The ejector 53 is provided with an abutting face 54 for abutment with a notch 62 of the circuit board 60. In order to pull out the circuit board 60, the lever 55 is pushed downwardly to turn the ejector 53 clockwise about the pin 52 so as to push upwardly the circuit board 60 with the abutting face 54, thus effecting disconnection from the contact elements.

A lift-type electrical connector is disclosed in U.S. Pat. No. 4,990,097. In this connector, an ejector is provided in sliding relation with the housing. When the top of the ejector is lift, the engaging portion provided on the lower end of the ejector engages the lower edge of the circuit board to lift the circuit board.

However, both of the above types suffer the following disadvantages:

Lever-Type Ejectors (1) The lever portion is turned outwardly, projecting from the connector and needs a large space to mount.

(2) In addition, a space for operating the lever portion is required. If the connector is mounted too close to a wall of the housing, etc., it is impossible to operate the lever portion.

(3) If the lever portion is incorporated in the housing, the housing becomes disadvantageously large.

Lift-Type Ejector (1) The top portion of the ejector projects from the connector to a large extent.

(2) A large force is required to pull out the circuit board because no lever action is made use of.

SUMMARY OF THE INVENTION

Accordingly, it is an object of the invention to provide a circuit board electrical connector having a compact and easy-to-use ejector.

According to the invention there is provided a circuit board electrical connector which includes a housing made from an insulation material; a plurality of contact elements arranged in the housing; a receiving recess provided in the housing for receiving a circuit board such that contact pads of the circuit board are brought into contact with the contact elements; an ejector provided on the housing for ejecting the circuit board so as to release the contact; a slide portion provided on the ejector and having surface member at a lower end thereof; a finger portion provided on the ejector and having bearing member in abutment on the surface member for receiving a pushing force from the slide portion; and a fulcrum member provided in the housing for supporting the finger portion between the bearing member and a front end of the finger portion for rotation to lift the circuit board, thereby ejecting the circuit board from the electrical connector.

With the electrical connector, it is possible to eject the circuit board by merely pushing downwardly the slide portion, which moves in a vertical direction only. When the slide portion is moved downwardly, the surface member pushes downwardly the bearing member of the finger portion, turning the finger portion about the fulcrum member. The turning finger portion lifts at the front end the circuit board to release the contact between the circuit board and the contact elements.

The above and other objects, features, and advantages of the invention will more apparent from the following description when taken in conjunction with the accompanying drawings.

DESCRIPTION OF THE PREFERRED EMBODIMENTS

First Embodiment

Figure 1:
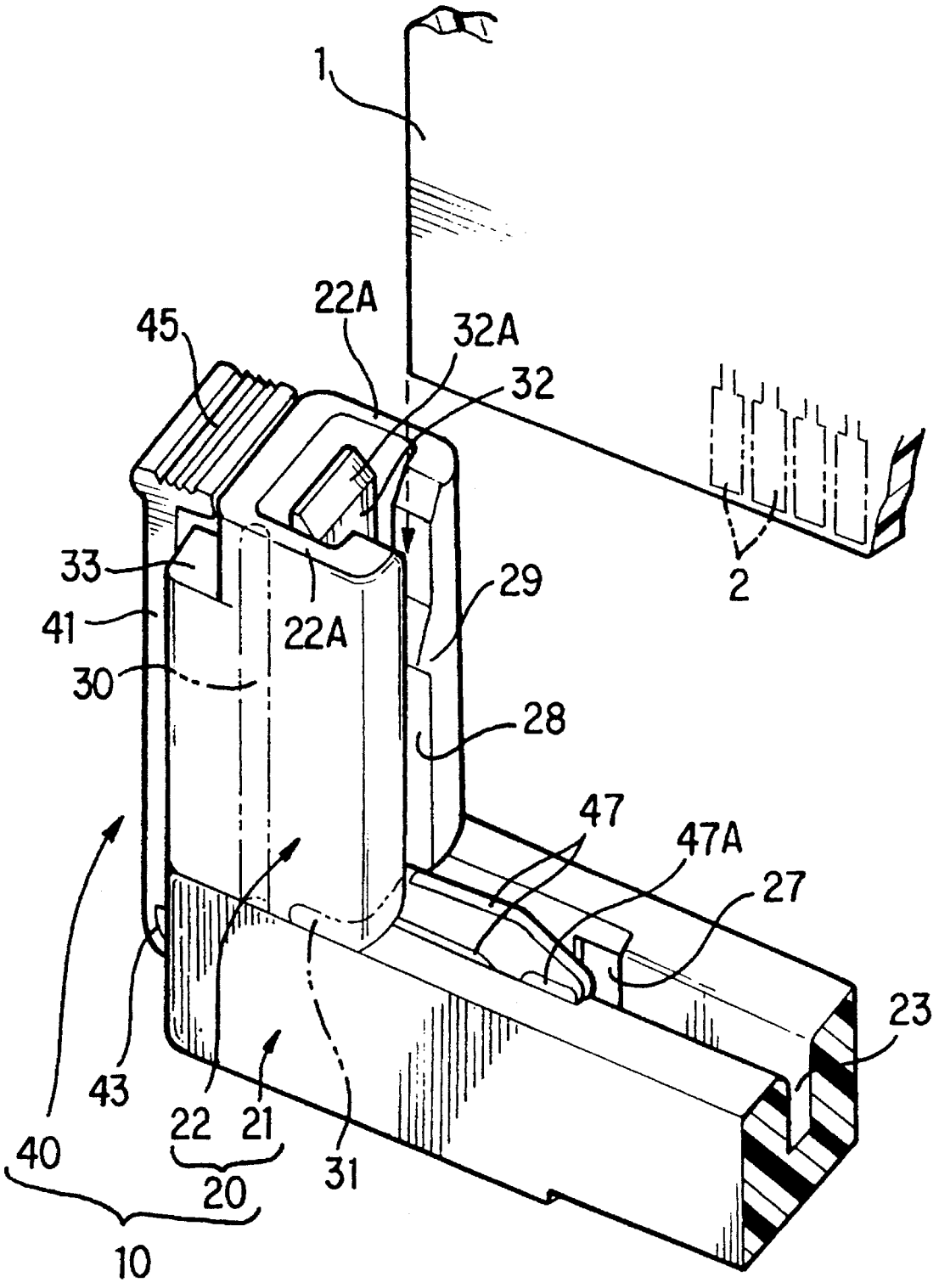
FIG. 1 is a perspective view of an electrical connector according to an embodiment of the invention.

In FIG. 1, a circuit board 1 has connection pads 2 arranged with a predetermined pitch on the lower edge thereof.

An electrical connector 10 for receiving the circuit board 1 includes a housing 20 made from an insulation material for holding the circuit board 1 with the connection pads 2 in contact with conductive contact elements which are arranged within the housing and an ejector 40 for lifting the circuit board 1 to a predetermined length so as to release the connection.

The housing 20 includes an elongated holding section 21 having the contact elements therein and a pair of guiding sections 22 extending upwardly from opposite ends of the holding section 21.

Figure 2:
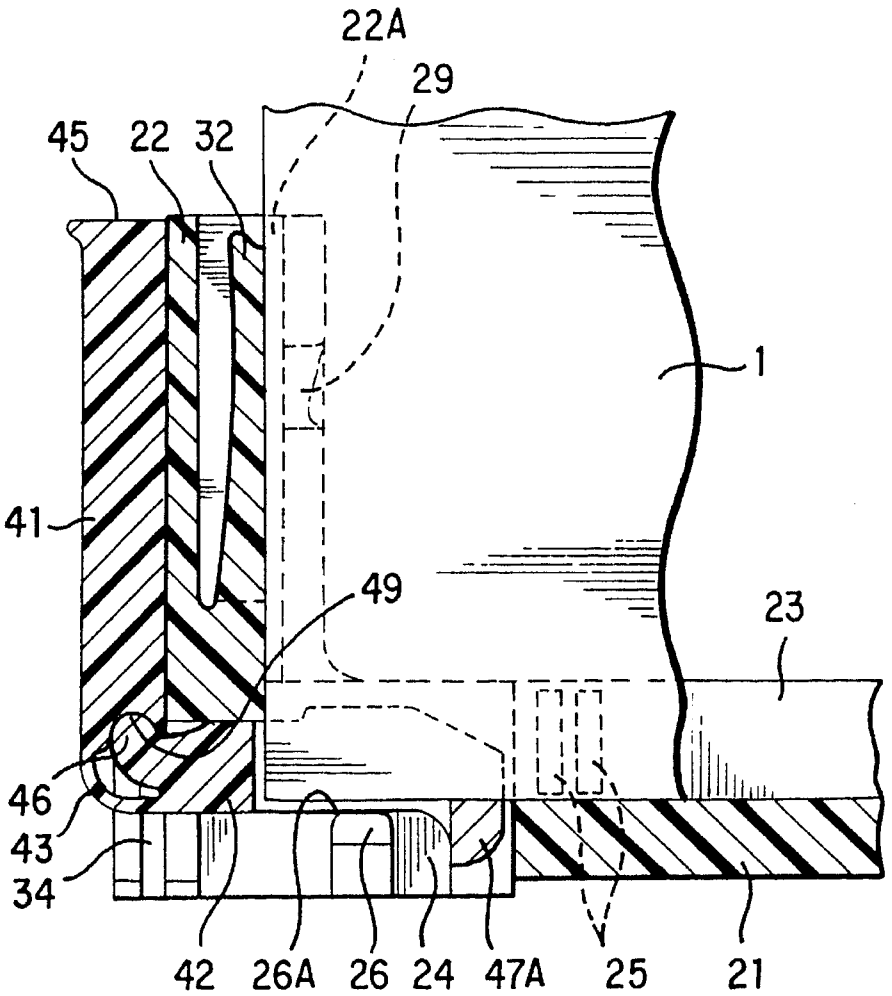
FIG. 2 is a longitudinal section of the electrical connector of FIG. 1.

In FIG. 2, the holding section 21 has a receiving recess 23 extending in the longitudinal direction of the holding section 21 and communicating with a pair of downward openings 24 on opposite portions of the holding section 21. The contact elements 25 are arranged within the receiving recess 23 between the downward openings 24 so as to contact the connection pads 2 when the circuit board 1 is inserted into the receiving recess 23. A pair of tapered projections 26 are provided on opposed inside walls of a downward opening 24. Each tapered projection 26 has a convex top surface 26A.

Referring back to FIG. 1, an engaging notch 27 is provided on an inside wall of the downward opening 24 between the tapered projection 26 and the outermost contact element 25. Each guiding section 22 has a pair of arm portions 22A defining a substantially C-shaped cross section with an receiving slot 28. The width of the receiving slot 28 is made greater than the thickness of the circuit board 1 and connected to the receiving recess 23 for guiding the circuit board 1 into the receiving recess 23. A projection 29 is provided on an surface of the receiving slot 28 at an intermediate position so that the distance between the projection 29 and the opposed surface of the receiving slot 28 is slightly smaller than the thickness of the circuit board 1. Alternatively, a pair of projections may be provided on opposed surfaces of the receiving slot 28. In place of the projection 29, part or whole of a surface of the receiving slot 28 may be formed so that the distance between the surface and the opposed surface of the receiving slot 28 is slightly smaller than the thickness of the circuit board 1. The arm portions 22A are made thinner than the other portions so that the receiving slot 28 is elastically expandable when the circuit board 1 is inserted into the slot 28. In order to facilitate the elastic expansion, it is preferred to provide a groove 30 on the base portion of an arm 22A for making the arm 22A thinner locally or a cutout 31 on the boundary between the holding section 21 and the guiding section 22.

A pair of elastic guide plates 32 are provided within the C-shaped guiding sections 22. Each guide plate 32 has a base portion connected with the arm portions 22A and an upper portion flexible in the widthwise direction of the circuit board 1. In order to facilitate insertion of the circuit board 1, the guide plate 32 has a tapered top portion 32A. The guiding section 22 has a fixed wall in the widthwise direction of the circuit board 1 so as to prevent the guide plate 32 from being flexed excessively.

A guiding section 22 is provided on the back with a protruded portion 33 extending from the base to the middle of the guiding section 22. The protruded portion 33 has an ejector channel 34 extending through the protruded portion 33.

Figure 3:
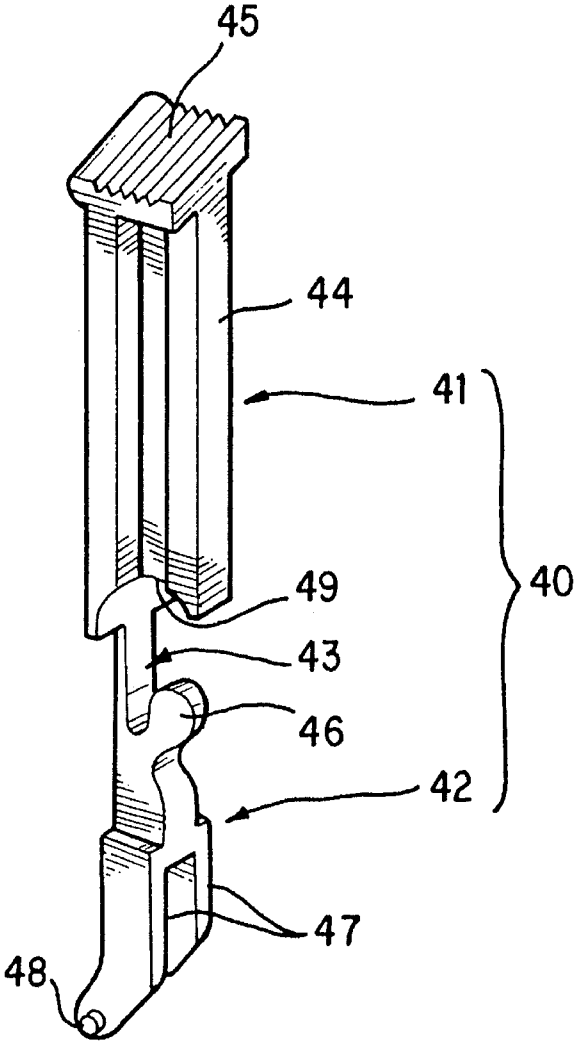
FIG. 3 is a perspective view of an ejector for the electrical connector.

In FIG. 3, an ejector 40 mounted in the ejector channel 34 has a slide portion 41, a finger portion 42, and a flexible linkage 43 between the portions 41 and 42 as a unit. Alternatively, the slide portion 41 and the finger portion 42 may be made separately and connected with a separate linkage.

The slide portion 41 has a ridge portion 44 put into the ejector channel 34 of the guiding section 22 for sliding movement and, on the top, a push portion 45 for pushing downwardly the slide portion 41. The push portion 45 is serrated for preventing slippage upon pushing.

The finger portion 42 has a cylindrical bearing 46 projecting obliquely upwardly and a fork portion 47 connected at a front end with a connecting member 47A. A stopper projection 48 is provided on an outer face of the front end of the fork portion 47. The slide portion 41 has on the lower end a concave surface 49 for receiving the cylindrical bearing 46 when the ejector 40 is bent at the flexible linkage 43.

Figure 4:
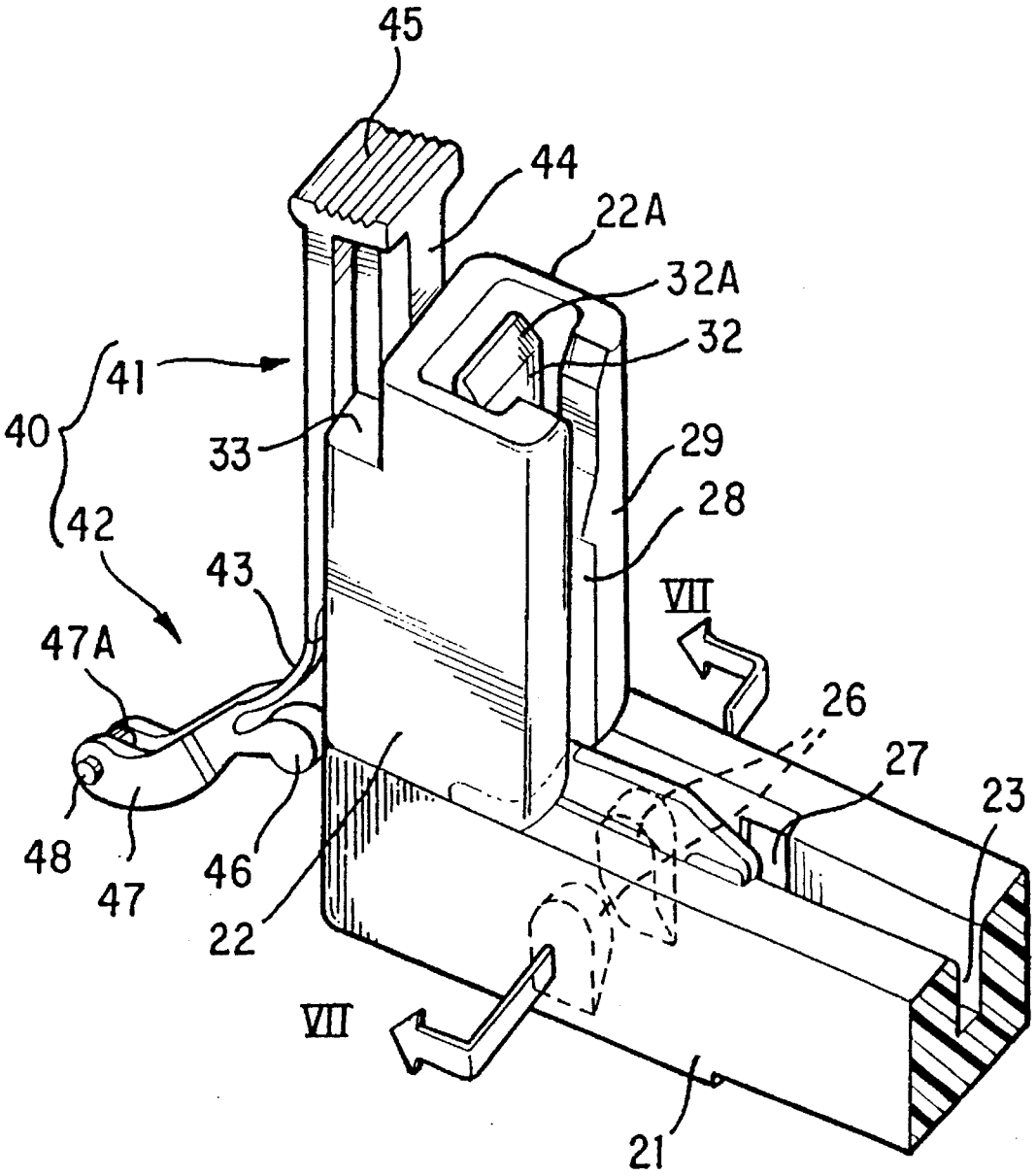
FIG. 4 is a perspective view of the ejector whose slide portion is put into a housing of the connector.

The ejector 40 is attached to the housing as follows:

(a) As shown in FIG. 4, the ridge portion 44 of the ejector 40 is put into the ejector channel 34 of the guiding section 22, with the finger portion 42 bent outwardly for facilitating the insertion.

Figure 5:
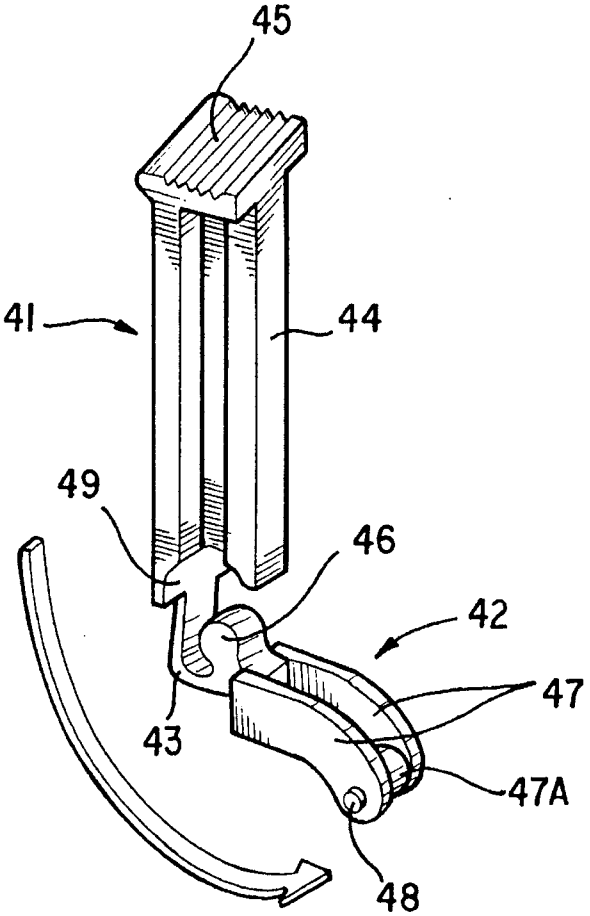
FIG. 5 is a perspective view of the ejector bent at a linkage portion so as to put a finger portion into the housing.

(b) As shown in FIG. 5, the finger portion 42 is then bent into the housing 10.

Figure 7:
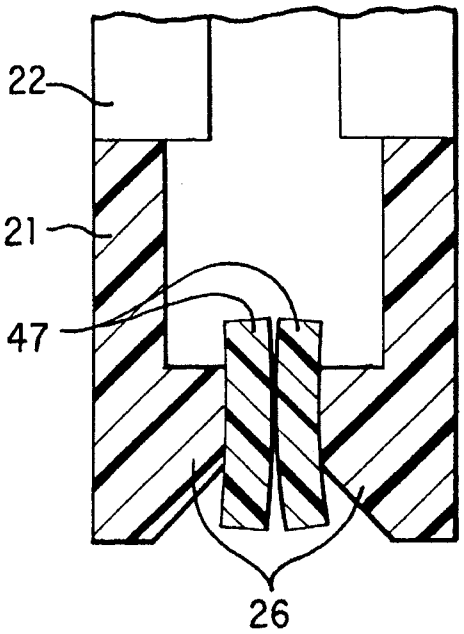
FIG. 7 is a sectional view taken along line VII—VII of FIG. 4 showing the finger portion passing a projection of the housing.
Figure 6:
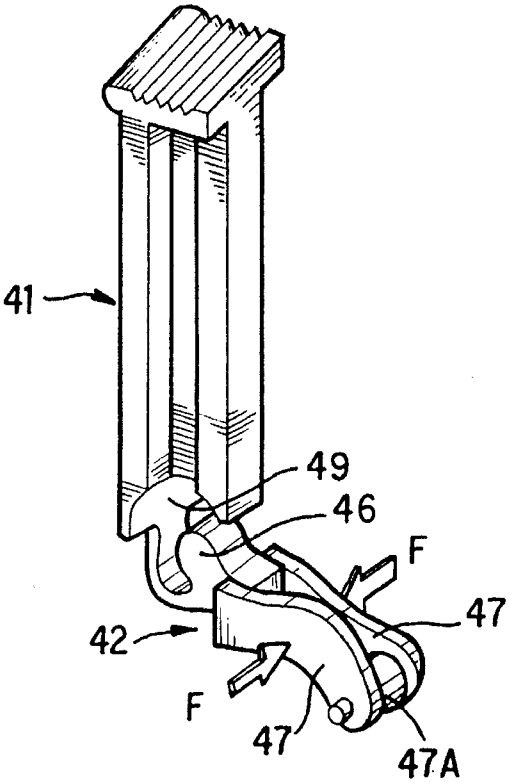
FIG. 6 is a perspective view of the ejector in which the finger portion undergoes elastic deformation.
Figure 8:
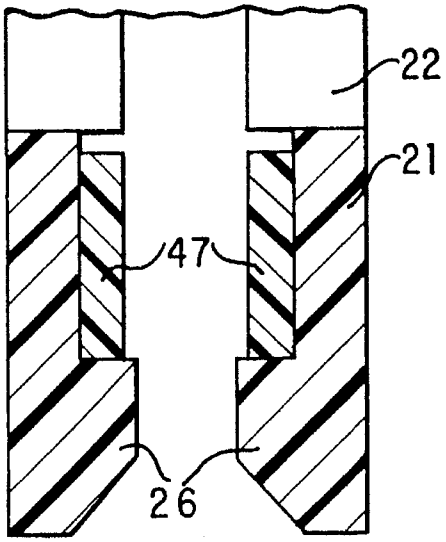
FIG. 8 is a sectional view similar to FIG. 7 showing the finger portion resting at a predetermined position in the housing.

(c) As shown in FIGS. 6 and 7, the fork portion 47 of the finger portion 42 undergoes elastic deformation between the tapered projections 26 of the downward opening 24. As shown in FIG. 8, upon passing the tapered projections 26, the fork portion 47 snaps into a space between the tapered projections 26 and the bottom of the guiding section 22. At the same time, the stopper projection 48 of the fork portion 47 engages the engaging recess 27 of the holding section 21.

(d) As shown in FIG. 2, the cylindrical bearing 46 of the finger portion 42 abuts on the concave surface 49 of the slide portion 41.

(e) Thus assembled connector is ready for receiving a circuit board.

How to plug a circuit board in or out of the electrical connector will be described below.

(1) As shown in FIG. 1, the circuit board 1 is inserted into the receiving slots 28 on both sides. The circuit board 1 is guided into a predetermined position by the guide plates 32 in the widthwise direction and by the receiving slots 28 in the thicknesswise direction.

(2) The leading edge of the circuit board 1 passes the projection 29 while expanding the receiving slot 28 and reaches the receiving recess 23 so that the connection pads 2 are brought into contact with the contact elements 25. Under this condition, the circuit board 1 is firmly held between the projection 29 and the opposed surface of the receiving slot 28.

Figure 9:
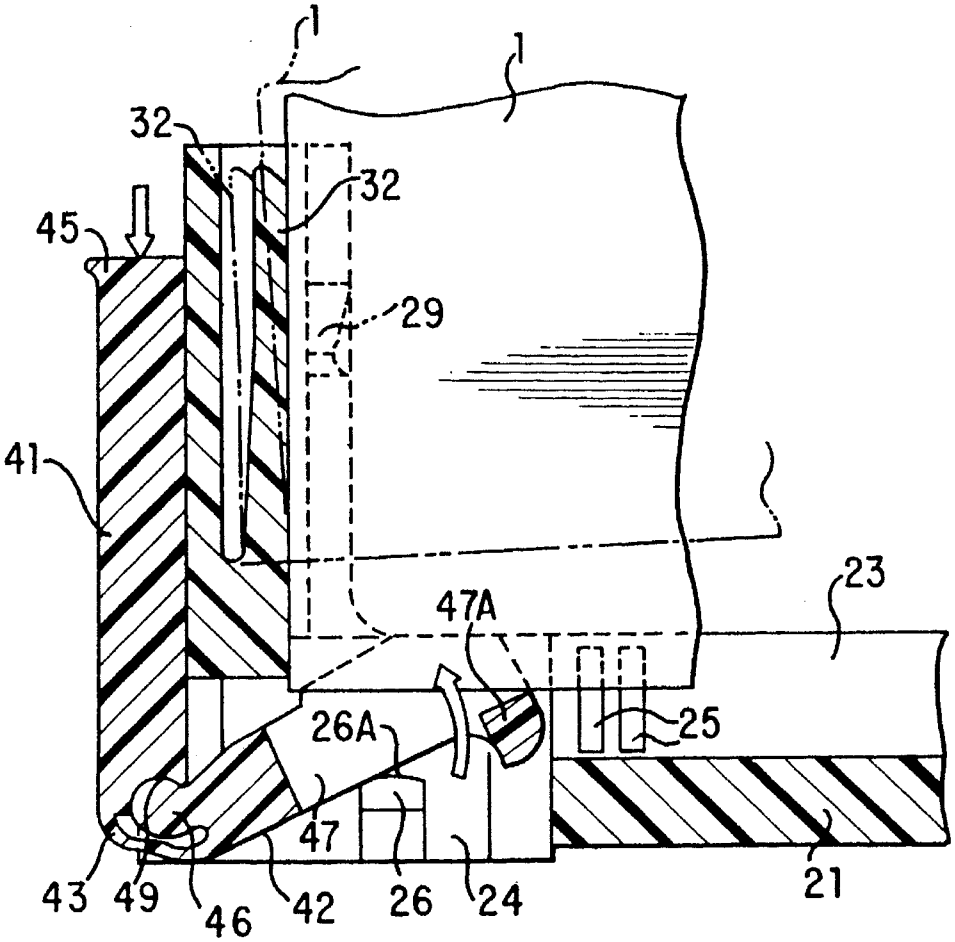
FIG. 9 is a longitudinal section of the electrical connector under a condition that a circuit board is being pulled out.

(3) In order to pull out the circuit board 1, it is necessary to apply a larger force to the circuit board 1 than the holding pressure of the contact elements 25 to release the connection. This is done by means of the ejector 40. As shown in FIG. 9, the push portion 45 of the ejector 40 is pushed downwardly so that the slide portion 41 of the ejector 40 is moved downwardly along the ejector channel 34.

(4) The concave surface 49 of the slide portion 41 then pushes downwardly the cylindrical bearing 46 of the finger portion 42. Consequently, the finger portion 42 is turned counterclockwise about the projection 26 so that the linking member 47A of the fork portion 47 is moved upwardly to lift the circuit board 1. In this way, the circuit board 1 is released from the contact elements 25. The fulcrum of rotation about the projection 26 moves to the left on the convex top surface 26A of the projection 26 as the finger portion 42 is turned counterclockwise; i.e., the arm length of moment between the front end and the fulcrum increases gradually. This is desirable because the arm length of moment first is small, thus producing a large force to release the connection and then is increased to lift the circuit board to a large extent.

Then, the stopper projection 48 of the finger portion 42 engages the engaging recess 27 of the holding section 21 to prevent unnecessary rotation of the finger portion 42.

(5) The thus released circuit board 1 is ready to be pulled out from the connector 10. If the circuit board 1 is pulled up in inclined posture as shown by broken line in FIG. 9, the guide plates 32 are flexed outwardly but tend to correct the inclination.

(6) After the circuit board 1 is released from the contact elements 25, the flexible linkage 43 of the ejector 40 is returned to the original condition so that the finger portion 42 and the slide portion 43 are returned to the respective original positions. Preferably, an engaging member or small projection is provided between the slide portion 41 and the ejector channel 34 to prevent the slide portion 41 from moving upwardly beyond the original position.

Second Embodiment

Figure 10:
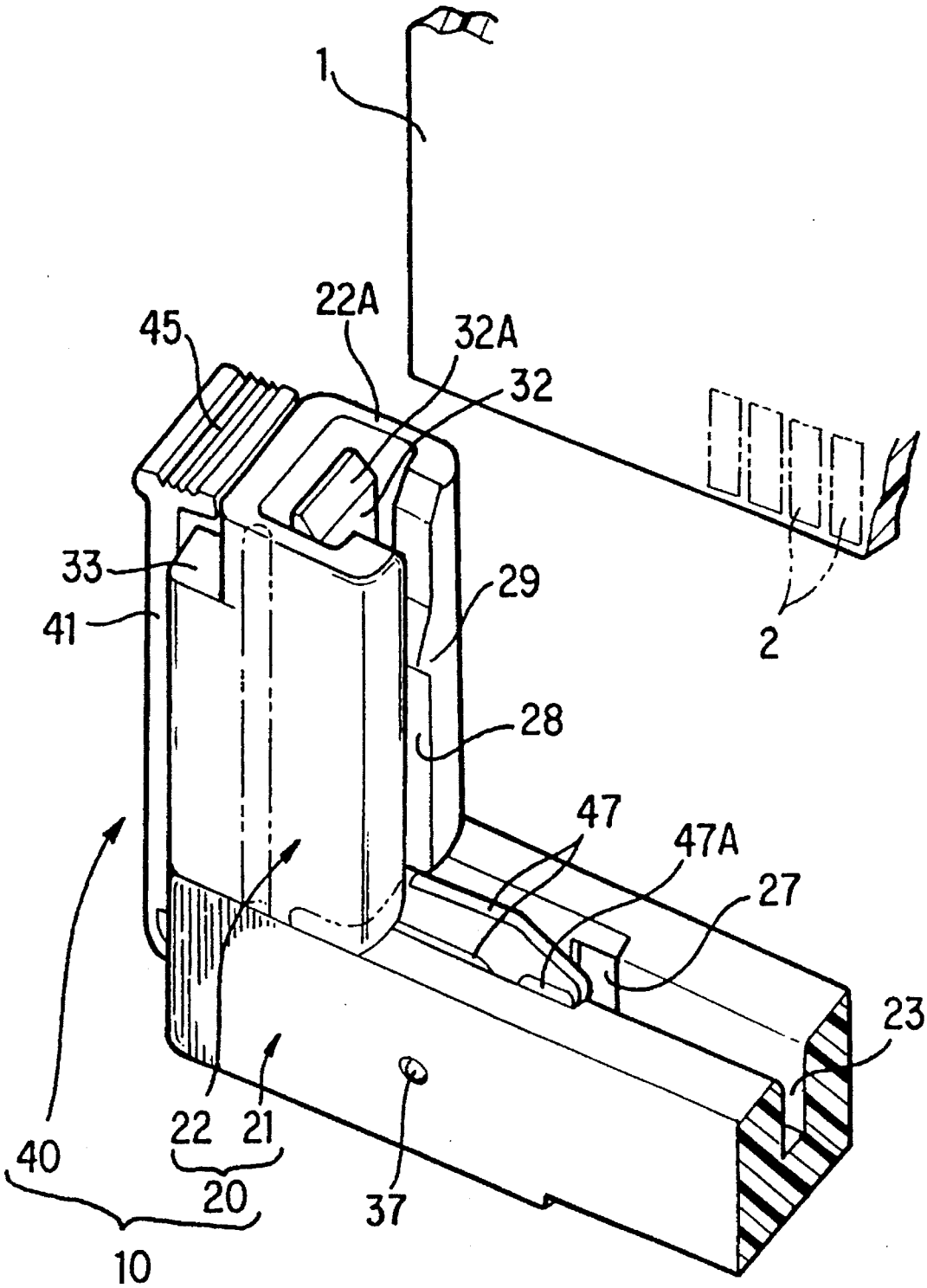
FIG. 10 is a perspective view of an electrical connector according to a second embodiment of the invention.
Figure 11:
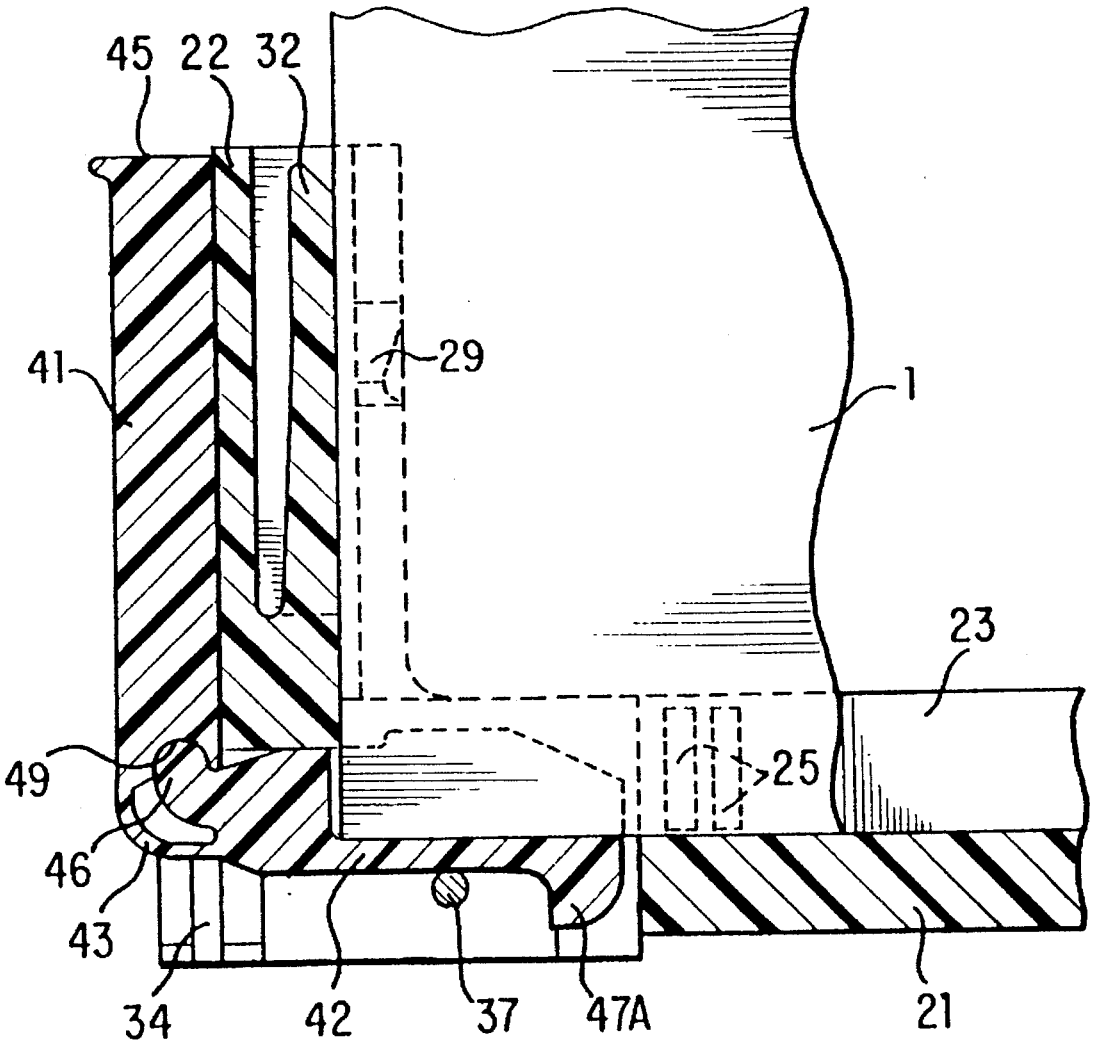
FIG. 11 is a longitudinal section of the electrical connector of FIG. 10.

In FIGS. 10 and 11, the same reference numbers in the second embodiment refer to corresponding or like components or parts of the first embodiment.

In place of the projection 26 of the first embodiment, a pin 37 is used in the holding section 21 as a fulcrum about which the finger portion 42 is turned. The pin 37 is struck into the holding section 21 after the finger portion 42 is housed in the holding section 21 for supporting the finger portion 42 for rotation.

Third Embodiment

Figure 12:
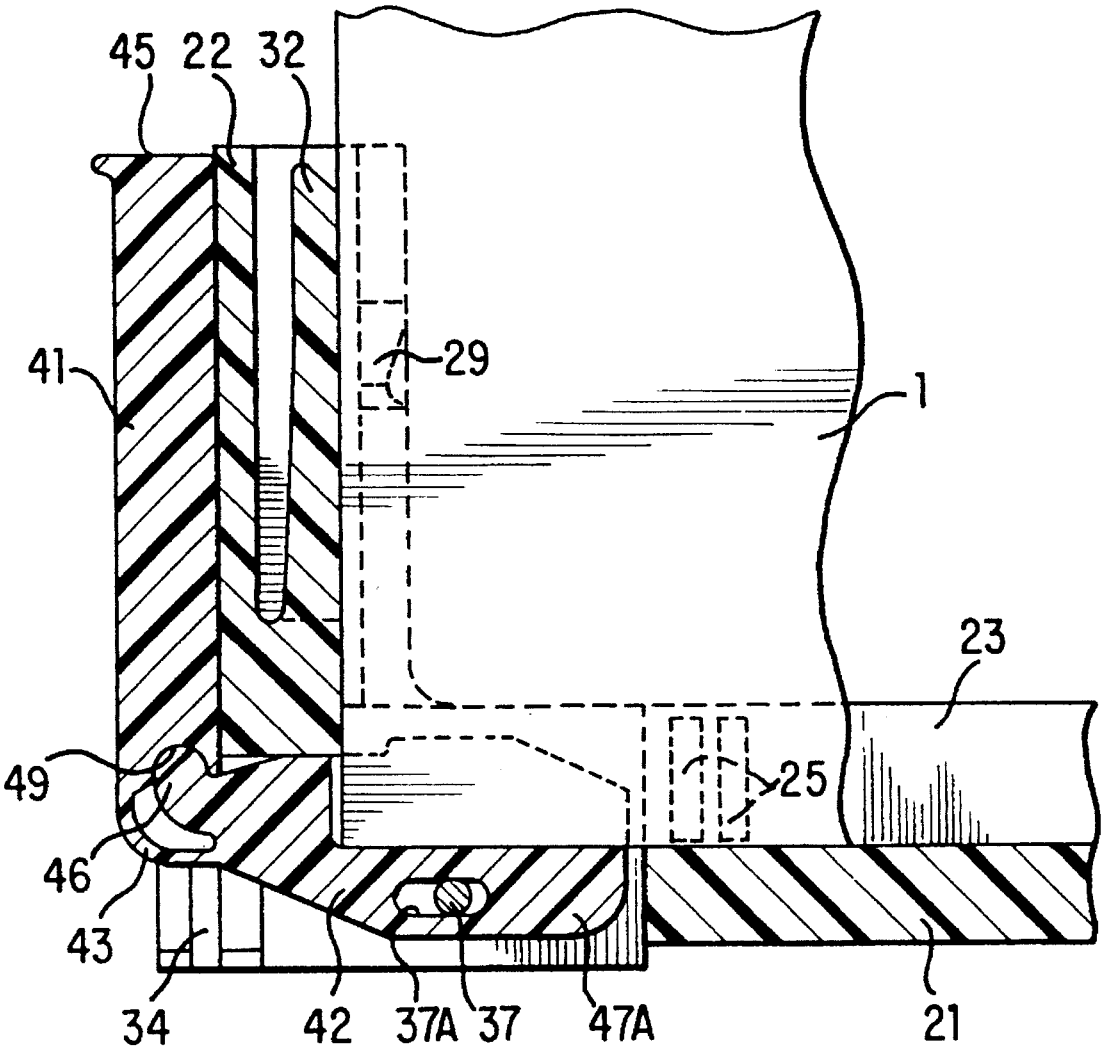
FIG. 12 is a longitudinal section of an electrical connector according to a third embodiment of the invention.
Figure 13:
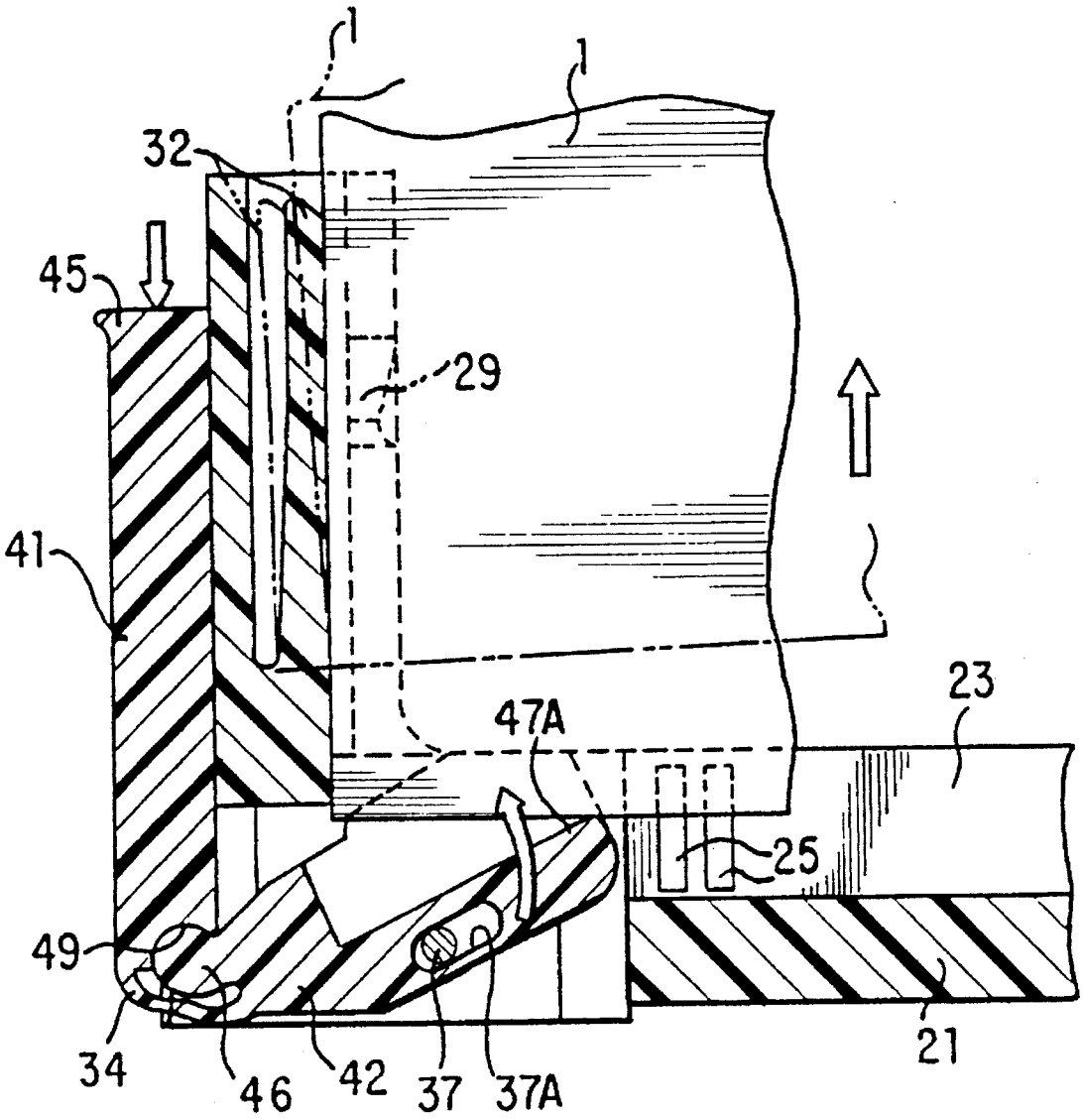
FIG. 13 is a longitudinal section of the electrical connector of FIG. 12 under a condition that a circuit board is being pulled out.
Figure 14:
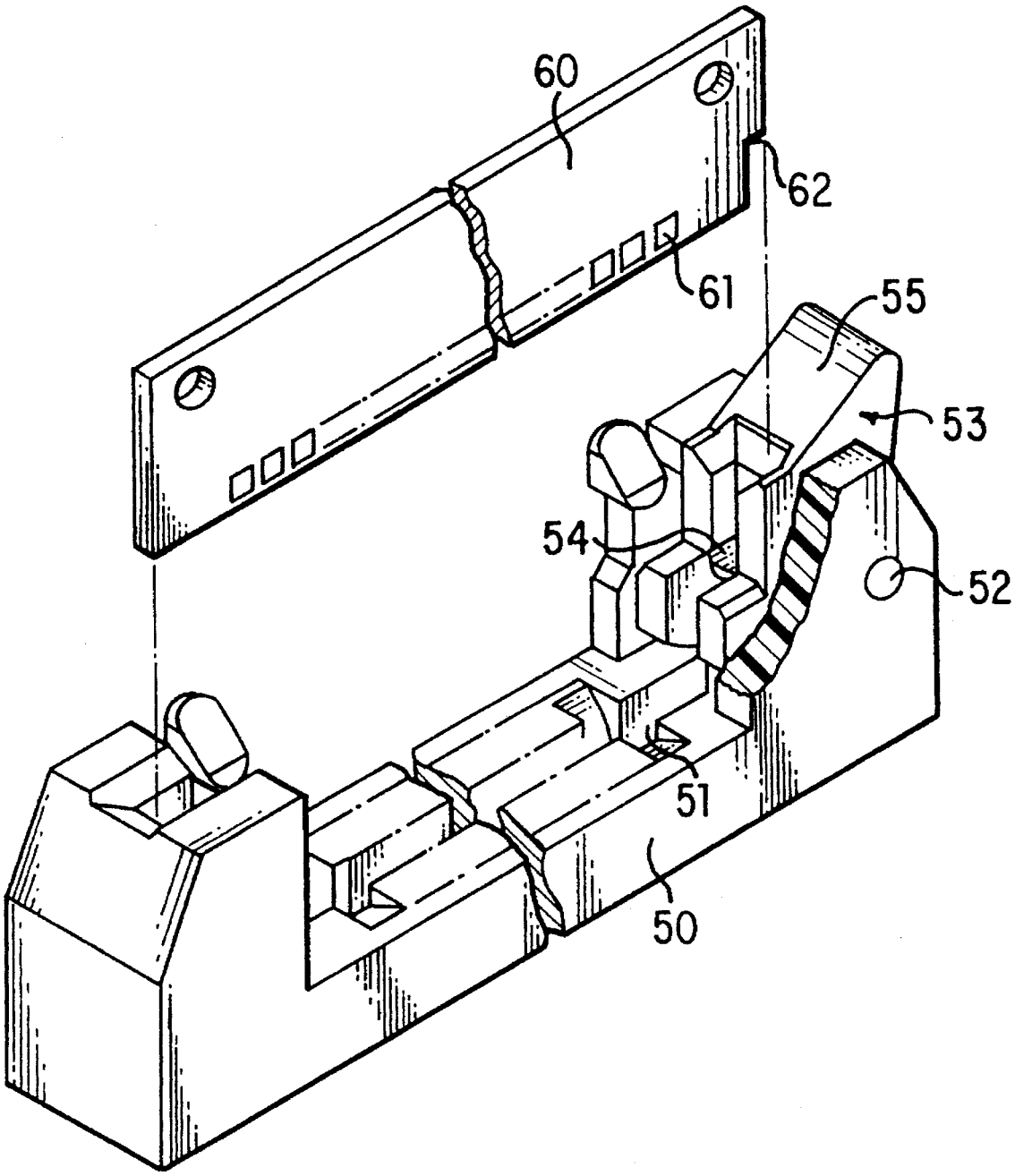
FIG.14 PRIOR ART
FIG. 14 is a perspective view of a conventional electrical connector.

In FIGS. 12 and 13, the finger portion 42 is provided with an elongated hole 37A through which the pin 37 is put. As the finger portion 42 is turned counterclockwise, the fulcrum of rotation is moved to the left in the elongated hole 37A, producing advantageous effects as in the first embodiment.

As has been described above, the circuit board is released from the contact elements by merely pushing downwardly the slide portion of the ejector so that there is no need for the large top portion to be picked up with fingers or any component moved outwardly to project from the housing, thus making the connector compact and high-density mounting possible. It is very easy to push downwardly the slide portion because there are large spaces in the lengthwise direction of the circuit board.

The invention claimed is:

1. A circuit board electrical connector, comprises:

a housing made from an insulation material so as to provide a holding section and a pair of guiding sections extending upwardly from opposite ends of said holding section;

a plurality of contact elements arranged in said holding section;

a receiving recess provided in said holding section for receiving a circuit board such that contact pads of said circuit board are brought into contact with said contact elements;

an ejector provided on said housing for ejecting said circuit board from said holding section;

a slide portion provided on said ejector for sliding along one of said guiding sections and having surface means at a lower end thereof;

a finger portion provided on said ejector and having bearing means abutted on said surface means of said slide portion when said ejector is attached to said housing so that when said slide portion is depressed downward in a solely vertical direction, said bearing means receives a pushing force from said slide portion and moves downwardly; and fulcrum means provided on said holding section for supporting said finger portion between said bearing means and a front end of said finger portion so that when said slide portion is depressed downwardly, said finger portion rotates to lift said circuit board with said front end of said finger portion, thereby ejecting said circuit board from said electrical connector.

2. A circuit board electrical connector according to claim 1, wherein said bearing means has a cylindrical surface and said surface means has a concave surface for receiving said bearing means.

3. A circuit board electrical connector according to claim 1, wherein said slide portion and said finger portion are connected as a unit with a flexible linkage provided between said surface means and said bearing means, respectively.

4. A circuit board electrical connector according to claim 1, wherein said fulcrum means is a pair of tapered projections.

5. A circuit board electrical connector according to claim 4, wherein said finger portion comprises a flexible fork portion with a front end connected with a connecting member so that said flexible fork portion is able to pass through a gap between said tapered projections and is supported by said tapered projections for rotation.

6. A circuit board electrical connector according to claim 1, wherein said fulcrum means is a pin.

7. A circuit board electrical connector according to claim 6, wherein said finger portion comprises an elongated hole through which said pin is put.

* * * * *